US005767332A

United States Patent [19]

Vollmer et al.

[11] Patent Number: 5,767,332

[45] Date of Patent: Jun. 16, 1998

[54] PROCESS AND APPARATUS FOR PRODUCING AROMATIC HYDROCARBON COMPOSITION

[75] Inventors: Hans-Jürgen Vollmer; Uwe Ranke, both of Essen; Reiner Wieczorkowski, Hattingen; Thottakudi Ramanuja Narasimhan, Essen, all of Germany

[73] Assignee: Krupp Koppers GmbH, Essen, Germany

[21] Appl. No.: 520,638

[22] Filed: Aug. 29, 1995

[30] Foreign Application Priority Data

Oct. 22, 1994 [EP] European Pat. Off. ..... 94116707

[51] Int. Cl.[6] ..... C07C 15/02; C10G 45/00

[52] U.S. Cl. ..... 585/401; 208/211; 208/254 H

[58] Field of Search ..... 585/401; 208/211, 208/254 H

[56] References Cited

U.S. PATENT DOCUMENTS

| | | | |
|---|---|---|---|
| 2,852,440 | 9/1958 | Smith et al. | 208/75 |
| 2,990,364 | 6/1961 | Fowle et al. | 208/209 |
| 3,296,120 | 1/1967 | Doelp et al. | 208/143 |
| 3,429,804 | 2/1969 | Sze et al. | 208/144 |
| 3,449,460 | 6/1969 | Tarhan | 585/251 |
| 4,166,025 | 8/1979 | Nametkin et al. | 208/126 |
| 4,247,729 | 1/1981 | Takahashi et al. | 585/483 |
| 4,422,927 | 12/1983 | Kowalcyzk et al. | 208/211 |
| 4,764,270 | 8/1988 | Hsieh et al. | 208/390 |

FOREIGN PATENT DOCUMENTS

| | | |
|---|---|---|
| 0 582 723 A1 | 7/1994 | European Pat. Off. . |
| 1 149 123 | of 1963 | Germany . |
| 95117122/04 | 3/1997 | Russian Federation . |
| 84 109 315 | of 0000 | Taiwan . |

*Primary Examiner*—Glenn Caldarola
*Assistant Examiner*—Thuan D. Dang
*Attorney, Agent, or Firm*—Herbert Dubno; Jonathan Myers

[57] ABSTRACT

In the production of aromatic hydrocarbon from coking crude by-product benzene after a vaporization stage in which the crude benzene is evaporated to leave a residue, the crude benzene is subjected to pressure refining in the presence of hydrogen. The residue is distilled to form high and low boiling fractions and at least the gas pressure and temperature of the distillation stage is controlled so that the sump product apart from styrene is substantially free from aromatic hydrocarbons with less than 9 carbon atoms. The rate of withdrawal of the vaporization residue from the vaporizing column is controlled, depending upon the concentration of polymer formers in the crude benzene to be in the range of 6 to 40% of the rate of feed of the coking by-product benzene to the vaporizing column.

6 Claims, 1 Drawing Sheet

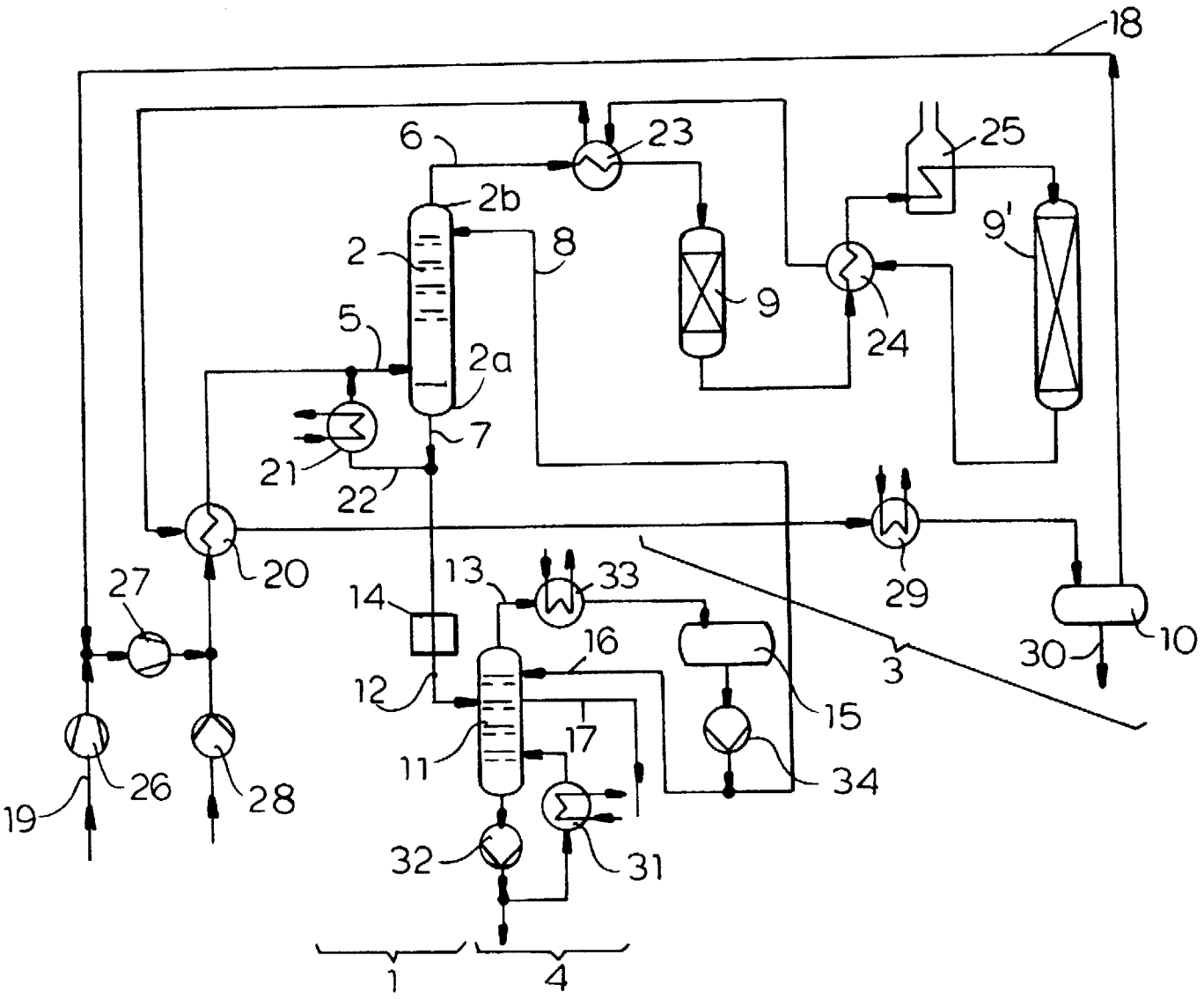
18
25
9'
24
9
23
8
2b
2a
6
2
5
7
22
21
20
27
28
26
19
10
30
29
3
15
34
33
16
17
31
13
14
12
11
32
4
1

PROCESS AND APPARATUS FOR PRODUCING AROMATIC HYDROCARBON COMPOSITION

SPECIFICATION

1. Field of the Invention

The present invention relates to a process for producing an aromatic-hydrocarbon-containing composition from coking by-product crude benzene which can be used for the recovery of high purity benzene and toluene and other components. The invention also relates to an apparatus for carrying out this process.

2. Background of the Invention

Coking by-product crude benzene is produced in the coking of coal, especially bituminous coal, for use in the steel industry and elsewhere and consists predominantly of benzene. Other components include toluene and xylenes, aromatic compounds with more than 8 carbon atoms and nonaromatic compounds.

Apart from these components the crude product contains a variety of sulfur, oxygen and nitrogen compounds as well as compounds with unsaturated C—C bonds.

In the past, the crude product was subjected to pressure refining with hydrogen to decompose the sulfur, nitrogen and oxygen compounds and to saturate the unsaturated carbon-carbon bonds. The result was an aromatic hydrocarbon containing composition which could be used for recovery of aromatic compounds and which, following the pressure refining, still contains gases like hydrogen sulfide, hydrogen and ammonia and can be somewhat unstable. This composition also contains toluene and xylenes which frequently must be recovered since these compounds are very important, in addition to benzene.

Since the pressure refining is a catalytic gas-phase reaction of the crude product with hydrogen, the crude product must initially be vaporized. For this purpose, a vaporization stage is usually provided. In the vaporization column, there is a certain separation of the coking by-product crude benzene into low boiling and high boiling components. The pressure refining stage requires pressures usually of 30 to 60 bar which are customarily applied already in the vaporization stage. The hydrogen which is used is not only technically pure hydrogen but can be hydrogen contained in coke oven gases which have a high hydrogen content. The pressure which is actually used can be determined by the hydrogen partial pressure which is a function of the hydrogen content of the coke oven gases.

In process or for producing aromatic-hydrocarbon compositions from coke by-product crude benzene, there is a problem which arises from the presence of polymerizable components in the coke by-product crude benzene, especially styrene and diolefines. These polymerable components tend to form polymers at elevated temperatures and elevated partial pressures and can result in the formation of deposits in the vaporization stage, in the distillation stage and in heat exchangers elsewhere in the system. As a consequence, the process must be interrupted frequently for the removal of such polymers. This interruption is particularly problematical when the time intervals between cleanouts is relatively short.

In a prior art process of this type, the low boiling fraction of the vaporization stage residue is recycled from the distillation stage to the feed coke by-product crude benzene. The distillation stage operates at atmospheric pressure and the temperature can be adjusted.

In practice, this process has been found to have a number of drawbacks. For example, a significant presence of aromatics with less than 9 C atoms tends to collect in the high boiling fraction so that the yield of the desired composition is unsatisfactory. In fact, seldom is less than 97% of the aromatics with less than 9 C atoms (relative to the content of the coke by-product crude benzene) found in the high boiling component. In addition, the greater volume of the high boiling fraction poses a problem.

On the other hand, relatively high boiling compounds like naphthalene can be found in the aromatic hydrocarbon composition which is recovered and which is detrimental to further processing of this composition or can reduce the value thereof.

In further processing where recovery of naphthalene is desirable, it is lost or is undesirably low in the high boiling fraction which may be processed by a tar distillation.

All of these drawbacks originate in the desire to provide relatively long time intervals between interruptions of the process for removal of the polymers and thus the need for limiting build up of the polymers as much as possible. It has been found that the problem derives at least in part from the prior relatively nonselective operation of the distillation stage and from the recycling of polymer forming substances in the low boiling fraction. Limitation of the recycle has hitherto been necessary to reduce the formation of deposits in the vaporization stage and heat exchangers.

OBJECTS OF THE INVENTION

It is therefore, the principal object of the present invention to provide an improved process for producing aromatic hydrocarbon compositions from coke by-product crude benzene, whereby drawbacks of earlier techniques are avoided.

Another object of the invention is to provide a process of the type described wherein, however, the reduction in formation of polymer deposits is more pronounced, interruption of the process for clean out of such deposits is delayed and, in general, the process can be conducted more efficiently.

It is also an object of the invention to provide an improved apparatus for carrying out the process.

SUMMARY OF THE INVENTION

The process of the invention for generating an aromatic hydrocarbon composition from coke by-product crude benzene is designed to provide a high yield of aromatic hydrocarbons in this product with less than 9 C atoms while reducing the amount of the high boiling fraction as resulting from the distillation stage to thereby delay interruption of the process for removal of deposits. This is achieved, in accordance with the invention by controlling the rate of the flow of the residue from the vaporization stage, depending upon the concentration of polymer formers in the coke by-product crude benzene so that it is between 6% and 40% of the rate of feed of the coke by-product crude benzene to the process. Furthermore, the low boiling fraction of the vaporization stage residue is withdrawn from the distillation stage, condensed and recycled to the head of the vaporization column as a reflux. In addition, in the distillation stage the gas pressure and temperature are adjusted as a parameter couple so that apart from styrene in the sump product, the sump product is practically free from aromatic hydrocarbons with less than 9 C atoms.

The invention is based upon the discovery that the use of the low boiling fraction as a reflux provides greater selectivity and separation sharpness with respect to the evaporation which occurs in the vaporization column. As a result, in this stage there is an increase in the yield of aromatic hydrocarbons with less than 9 C atoms in the vapor phase and simultaneously an increased transfer of hydrocarbons with more than 8 C atoms into the vaporization residue.

It is thus possible by selection of the parameter couple, namely, gas pressure and temperature to eliminate practically all aromatic hydrocarbons with less than 9 C atoms from the sump product of the distillation stage (apart from styrene) which insures a sharp reduction in the deposit of polymers in the system. This also depends, as indicated, upon controlling the rate of flow of the residue from the vaporization stage to the distillation column.

Surprisingly, a further reduction in the formation of polymer deposits can be achieved when the rate of flow of the residue withdrawn from the vaporization stage is adjusted in accordance with the concentration of polymer formers in the original coke by-product crude benzene. As a general rule with higher concentrations of such polymer formers, there is a higher rate of flow of the residue of the vaporization stage and vice versa.

The process of the invention can thus comprise the steps of:

(a) in a vaporization stage, evaporating coking by-product crude benzene in a vaporizing column in the presence of a hydrogen stream and under pressure to produce a vapor phase and a vaporization residue;

(b) in a pressure refining stage connected to the vaporization stage reacting the vapor phase of the coking by-product crude benzene with hydrogen to produce an aromatic hydrocarbon composition from which aromatic compounds are recoverable;

(c) withdrawing the vaporization residue from the vaporizing column and separating the withdrawn vaporization residue in a distillation column of a distillation stage into a low-boiling fraction and a high-boiling fraction and discharging the high-boiling fraction from the distillation column as a sump product;

(d) condensing the low-boiling fraction from the distillation stage and feeding the condensed low-boiling fraction to a head of the vaporization column as a reflux therein;

(e) controlling at least a parameter couple consisting of the gas pressure and the temperature of the distillation stage so that the sump product apart from styrene is substantially free from aromatic hydrocarbons with less than 9 carbon atoms; and (f) controlling the rate of withdrawal of the vaporization residue from the vaporizing column, depending upon a concentration of polymer-formers in the coking by-product crude benzene, to be in the range of 6% to 40% of the rate of feed of the coking by-product crude benzene to the vaporizing column.

In a preferred embodiment of the invention, the pressure in the distillation stage is equal to or less than atmospheric pressure, i.e. a vacuum can be applied. The term "vacuum" is here used in the sense common in distillation technology. In the distillation stage, moreover, a temperature of less than 200° C. should be provided. Both of these features can be used together, i.e. in combination and provide mild distillation conditions which can reduce the formation rate of polymers in the distillation stage.

According to another feature of the invention, a mixture of dicyclopentadiene, benzofuran, indene and indane is separately withdrawn from the distillation stage, i.e. is withdrawn from the distillation stage separately from the sump product. This mixture has been found to be particularly suitable for the production of benzofuran resins. The mixture is withdrawn from a side arm of the distillation column between the head and sump thereof. A separation of this type can be carried out because the distillation stage, as previously indicated, is operated with high selectivity and resolution.

Advantageously, the hydrogen is recycled, thereby affording optimum utilization of the hydrogen or hydrogen containing coke gas which is employed.

Of course, the hydrogen or fresh coking gas must be introduced into the system as the hydrogen is consumed in the pressure refining stage.

An apparatus for carrying out the process of the invention can comprise:

a vaporization stage for evaporating coking by-product crude benzene in a vaporizing column in the presence of a hydrogen stream and under pressure to produce a vapor phase and a vaporization residue;

a pressure refining stage connected to the vaporization stage for reacting the vapor phase of the coking by-product crude benzene with hydrogen to produce an aromatic hydrocarbon composition from which aromatic compounds are recoverable;

a condenser/separator connected to the pressure refining stage for separating hydrogen from the aromatic hydrocarbon composition;

a distillation stage connected to the vaporization stage and including means for withdrawing the vaporization residue from the vaporizing column and a distillation column for separating the withdrawn vaporization residue into a low-boiling fraction and a high-boiling fraction and discharging the high-boiling fraction from the distillation column as a sump product;

means for condensing the low-boiling fraction from the distillation stage and feeding the condensed low-boiling fraction to a head of the vaporization column as a reflux therein; and a flow rate control element between a sump of the vaporization column and an inlet into the distillation column for controlling a rate of flow of the vaporization residue into the distillation column.

The means for condensing also can include a condenser separator. The distillation column can be provided with means for returning part of the low boiling fraction following condensation to the distillation column as a reflux.

BRIEF DESCRIPTION OF THE DRAWING

The above and other objects, features, and advantages will become more readily apparent from the following description, reference being made to accompanying drawing, the sole FIGURE of which is a flow diagram illustrating the invention.

SPECIFIC DESCRIPTION

As can be seen from the drawing, a vaporization stage 1 is followed by a refining stage 3 and a distillation stage 4.

In the vaporization stage 1, a vaporization column 2 is provided. In practice, the vaporization column 2 can be a multistage evaporation, e.g. of the plate or bubble column type or otherwise directed to collect a sump product in the sump to the column while discharging a head product vapor from the head to be of column 2.

The vaporization in column 2 may be replaced by any equivalent evaporator. The column 2 serves for vaporizing coke oven crude benzene in the presence of a hydrogen stream and under pressure. It has a crude benzene feed pipe 5 which opens into the column 2 immediately above the sump. The vaporization heat is supplied to the crude benzene and recycled through the sump by a heat exchanger 20 recovering waste heat from the vapor phase and a heater 21 through which sump product is recycled at 22.

At the head 2*b* of the column 2, a line 6 withdraws the vapor phase which can be condensed or cooled in a heat exchanger 23 before this head product is admitted to one stage of a pressure refiner 9, 9' in which the coke by product crude benzene is required with hydrogen to form the aromatic composition from which benzene, toluene, xylenes and the like can be removed. The product is condensed in a condenser/separator 10.

In practice, it has been found to be advantageous to break the pressure refining stage into two pressure refiners 9 and 9', the reaction product from the reactor 9 passing through a heat exchanger 24 and a heat furnace 25 before entering the reactor 9'. At 19, hydrogen is fed to the system in the form of coke oven gas rich hydrogen, the coke oven gas being supplied by the compressor 26 and being combined with recycled coke oven gas from line 18 leaving the separator 10. The mixture is fed under pressure from a compressor 27 through the heat exchanger 20 to line 5 to enter the evaporator 2 together with the crude benzene supplied by the pump 28. The waste heat of the product aromatic composition is thus used to heat the mixture entering the vaporizing unit 2. The product mixture can be further cooled in a heat exchanger 29 and condenses in the chamber 10 from which separated gas is recycled at 18. The product mixture is discharged at 30.

The vaporizer 2 thus has the pipe 7 for discharging the sump product or vaporization residue which is fed to the inlet line 12 of a distillation column 11.

A supply line 8 feeds into the vaporization column 2 close to the head to be thereof.

The pressure refiners 9 and 9' are connected in series.

The distillation stage 4 comprises the distillation column 11 for separating the vaporization residue from the vaporization stage 2 into a low boiling fraction and a high boiling fraction. The heat for the distillation stage is supplied by a heat exchanger 31 which boils a portion of the sump product extracted by the pump 32 before recycling it to the distillation column 11. The low boiling fraction is carried off via line 13 from the head of column 11. At an intermediate region, a side outlet 17 serves to discharge a mixture which consists substantially of dicyclopentadiene, benzofuran, indene and indane.

In the line between the sump outlet 7 of the vaporization column 2 and the inlet 12 to the distillation column 11, a flow rate controller 14 is provided.

In the line 13, a heat exchanger 33 is provided to cool the vapor and provide a condensate which is collected in the condenser/separator 15. A pump 34 can feed that condensate partly as a reflux at 16 to the head of the distillation column 11 and partly to the head of the vaporization column 2*b* via the line 8 previously mentioned.

In the drawing, it is clear that the hydrogen, in the form of coke oven gas, is recycled.

The apparatus of the drawing functions in the manner previously described. The coke by-product crude benzene is fed with hydrogen under pressure to the vaporization column to form the vaporization residue in the sump 2*a* and the vapor phase at the head 2*b*. The vaporized crude benzene is reacted catalytically with hydrogen in the pressure refining stage 3 and the vaporization residue is withdrawn from the sump 2*a* and subjected to distillation in the column 11 into the high boiling and low boiling fraction.

The low boiling fraction is condensed from the distillation stage 4 and fed as a reflux to the head of the vaporization column 2. In the distillation stage the gas pressure and temperature are so set that the sump product with the exception of a styrene, is practically free from aromatic hydrocarbons with less than 9 carbon atoms.

In the distillation stage 4 the pressure is maintained at or less than atmospheric pressure and the temperature is maintained at less than 200° C. As a rule the temperature here should lie above 100° C.

Because of these temperature and pressure levels in the column 2, between 5 and 55% of the vaporization residue is evaporated at the base of the distillation column. The distillation column can be equipped with 20 theoretical plates.

In the vaporization stage 1 the rate of withdrawal of the vaporization residue, depending upon the concentration of polymer formers in the crude benzene, is set at 6% to 40% of the rate of flow of the crude benzene. A mixture of dicyclopentadiene, benzofuran, indene and indane is withdrawn from the lateral outlet 17 of column 11 separate from the sump product. Investigations have shown that the quantities of the high boiling fraction in the distillation stage can be reduced to 0.5 to 1% of the feed coke by-product crude benzene. The yield of hydrocarbons with more than 8 C atoms in the high boiling fraction, with reference to the coke by-product benzene input is greater than 97%.

Investigations as to the formation of deposits have indicated that the time interval between interruptions of the process to remove deposits can exceed 1 year.

The aromatic hydrocarbon product at 30 can be separated to recover benzene and toluene by the method described in the commonly assigned copending application Ser. No. 08/517,009 filed 18 Aug. 1995.

We claim:

1. A process for producing an aromatic hydrocarbon composition from coking byproduct crude benzene, said process consisting essentially of the steps of:

(a) in a vaporization stage, evaporating coking byproduct crude benzene in a vaporizing column in the presence of a hydrogen stream and under pressure to produce a vapor phase and a vaporization residue;

(b) in a pressure refining stage connected to said vaporization stage reacting said vapor phase of the coking byproduct crude benzene with the hydrogen to produce an aromatic hydrocarbon composition from which aromatic compounds are recoverable;

(c) withdrawing said vaporization residue from said vaporizing column and separating the withdrawn vaporization residue in a distillation column of a distillation stage into a low-boiling fraction and a high-boiling fraction and discharging said high-boiling fraction from said distillation column as a sump product;

(d) condensing said low-boiling fraction from said distillation stage and feeding the condensed low-boiling fraction to a head of said vaporization column as a reflux therein;

(e) controlling at least a parameter couple consisting of the gas pressure and the temperature of said distillation stage so that said sump product apart from styrene is substantially free from aromatic hydrocarbons with less than 9 carbon atoms; and (f) controlling the rate of withdrawal of said vaporization residue from said vaporizing column, depending upon a concentration of polymer-formers in the coking byproduct crude benzene, to be in the range of 6% to 40% of the rate of feed of the coking byproduct crude benzene to the vaporizing column.

2. The process defined in claim 1, wherein according to step (c) a pressure of at most atmospheric pressure is maintained.

3. The process defined in claim 1, wherein according to step (c) a temperature less than 200° C. is maintained.

4. The process defined in claim 1, wherein following step (c) a mixture of dicyclopentadiene, benzofuran, indene and indane is separately recovered from said sump product.

5. The process defined in claim 1, wherein following step (b) the hydrogen stream is recycled to step (a).

6. A process for producing an aromatic hydrocarbon composition from coking byproduct crude benzene, said process consisting essentially of the steps of:

(a) in a vaporization stage, evaporating coking byproduct crude benzene in a vaporizing column in the presence of a hydrogen stream and under pressure to produce a vapor phase and a vaporization residue;

(b) in a pressure refining stage connected to said vaporization stage reacting said vapor phase of the coking byproduct crude benzene with hydrogen to produce an aromatic hydrocarbon composition from which aromatic compounds are recoverable;

(c) withdrawing said vaporization residue from said vaporizing column and separating the withdrawn vaporization residue in a distillation column of a distillation stage, wherein a pressure of less than atmospheric pressure and a temperature of less than 200 degrees C. is provided, into a low-boiling fraction and a high-boiling fraction and discharging said high-boiling fraction from said distillation column as a sump product;

(d) condensing said low-boiling fraction from said distillation stage and feeding the condensed low-boiling fraction to a head of said vaporization column as a reflux therein;

(e) controlling at least a parameter couple consisting of the gas pressure and the temperature of said distillation stage so that said sump product apart from styrene is substantially free from aromatic hydrocarbons with less than 9 carbon atoms; and (f) controlling the rate of withdrawal of said vaporization residue from said vaporizing column, depending upon a concentration of polymer-formers in the coking byproduct crude benzene, to be in the range of 6% to 40% of the rate of feed of the coking byproduct crude benzene to the vaporizing column.

* * * * *